US006701656B2

(12) United States Patent
Schlenkert et al.

(10) Patent No.: US 6,701,656 B2
(45) Date of Patent: Mar. 9, 2004

(54) WEAPON BARREL HAVING A HARD CHROMIUM INNER LAYER

(75) Inventors: Gert Schlenkert, Düsseldorf (DE); Hartmut Wagner, Unterlüss (DE); Horst Reckeweg, Heiligenhaus (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/095,476

(22) Filed: Mar. 13, 2002

(65) Prior Publication Data

US 2002/0095846 A1 Jul. 25, 2002

Related U.S. Application Data

(62) Division of application No. 09/363,651, filed on Jul. 30, 1999, now Pat. No. 6,381,893.

(30) Foreign Application Priority Data

Jul. 30, 1998 (DE) ..... 198 34 394

(51) Int. Cl.[7] ..... F41A 21/00

(52) U.S. Cl. ..... 42/76.02; 419/8; 428/36; 89/16; 89/14.05

(58) Field of Search ..... 42/76.02; 89/16, 89/14.05; 419/8; 428/36

(56) References Cited

U.S. PATENT DOCUMENTS

| | | | | | |
|---|---|---|---|---|---|
| 3,943,040 | A | | 3/1976 | Willson | 204/5 |
| 4,435,455 | A | * | 3/1984 | Prewo et al. | 42/76.02 |
| 4,469,532 | A | * | 9/1984 | Nicolas | 148/279 |
| 4,641,450 | A | * | 2/1987 | Moll et al. | 138/140 |
| 4,747,225 | A | * | 5/1988 | Gstettner et al. | 126/56 |
| 4,756,677 | A | * | 7/1988 | Hribernik et al. | 419/28 |
| H543 | H | * | 11/1988 | Chen et al. | 428/635 |
| 4,911,060 | A | * | 3/1990 | Greenspan et al. | 42/76.02 |
| 5,182,139 | A | * | 1/1993 | Frankel et al. | 427/239 |
| 5,341,719 | A | * | 8/1994 | Bullis et al. | 89/14.05 |
| 5,582,707 | A | * | 12/1996 | Chizhevski | 106/1.25 |

FOREIGN PATENT DOCUMENTS

| | | | | |
|---|---|---|---|---|
| DE | 2 244 029 | | 3/1973 | |
| DE | 41 07 273 | | 9/1992 | |
| DE | 04419864 | A1 * | 12/1995 | C25D/17/12 |
| DE | 19918794 | A1 * | 11/2000 | F41A/21/00 |
| EP | 01048920 | A2 * | 11/2000 | F41A/21/22 |
| FR | 2 549 090 | | 1/1985 | |
| GB | 1 409 059 | | 10/1975 | |
| GB | 1 456 355 | | 11/1976 | |

* cited by examiner

*Primary Examiner*—Michael J. Carone
*Assistant Examiner*—Denise J Buchley
(74) *Attorney, Agent, or Firm*—Venable LLP; Stuart I. Smith

(57) ABSTRACT

A weapon barrel includes a hard chromium layer provided on an inner barrel surface. The hard chromium layer contains at least 500 fissures/cm in a cross-sectional plane.

2 Claims, 1 Drawing Sheet

FIG.1
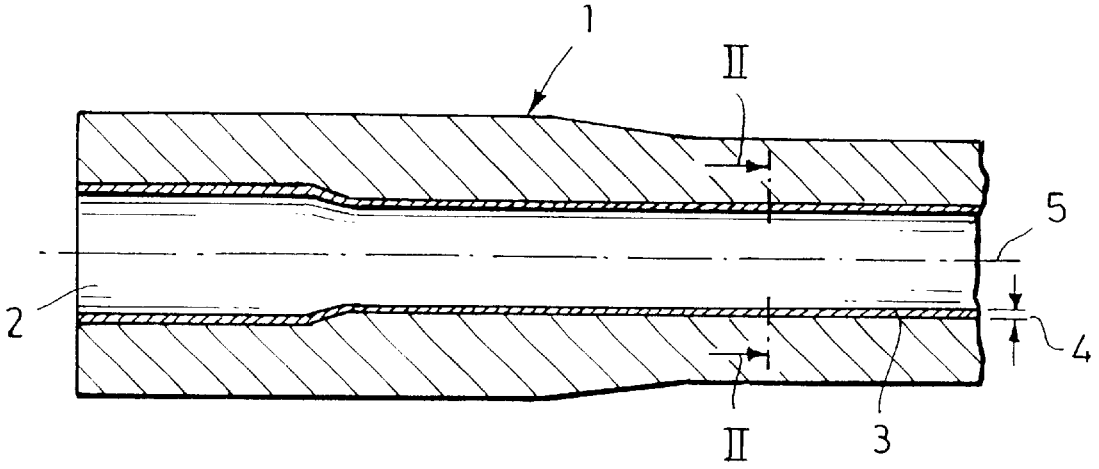
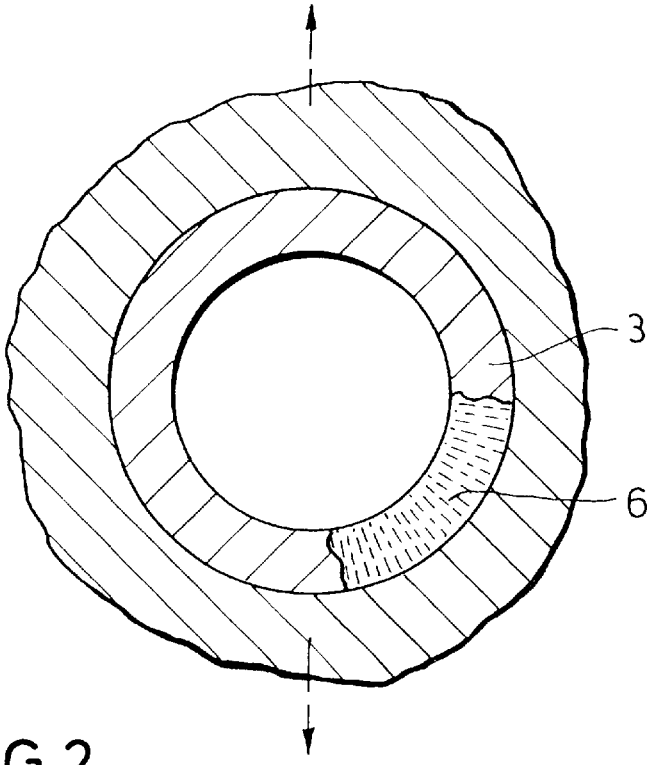
FIG.2

WEAPON BARREL HAVING A HARD CHROMIUM INNER LAYER

CROSS REFERENCE TO RELATED APPLICATION

This application is a division of application Ser. No. 09/363,651 filed Jul. 30, 1999, now U.S. Pat. No. 6,381,893.

This application claims the priority of German Application No. 198 34 394.9 filed Jul. 30, 1998, which is incorporated herein by reference.

BACKGROUND OF THE INVENTION

This invention relates to a weapon barrel provided with an internal, wear-reducing hard chromium layer including a plurality of microfissures.

The hot powder burst generated upon firing of ammunition leads to abrasive and erosive wear phenomena in the unprotected inner wall of a weapon barrel usually made of steel. Such phenomena adversely affect the range and accuracy of the weapon and lead to a premature fatigue of the weapon.

It is known to provide the inner wall face of a large caliber weapon barrel with a hard chromium layer for reducing an erosive barrel wear, as disclosed, for example, in German Offenlegungsschrift (application published without examination) 41 07 273. It has been found, however, that the high stresses caused by the thermal shock upon firing may effect a gradual peeling of the chromium layer. As a result, at those locations the weapon barrel is no longer protected from the hot powder gases which thus cause erosions there.

Since the peeling of the chromium layer is caused by the microfissures which appear during the application of the chromium layer, German Offenlegungsschrift 41 07 273 proposes to prevent such a peeling by filling the microfissures with a low-friction substance such as polytetrafluorethylene.

It is a disadvantage of the above-noted known weapon barrels that their manufacture is relatively expensive. Further, the microfissures embedded in the chromium layer cannot be filled with the low-friction substance so that such fissures retain their harmful effect inducing the peeling of the chromium layer.

SUMMARY OF THE INVENTION

It is an object of the invention to provide an improved weapon barrel of the above-outlined type whose hard chromium layer has, as compared to conventional hard chromium layers, an improved resistance to thermal shocks without the need to fill the microfissures with a low-friction substance.

This object and others to become apparent as the specification progresses, are accomplished by the invention, according to which, briefly stated, the weapon barrel includes a hard chromium layer provided on an inner barrel surface. The hard chromium layer contains at least 500 fissures/cm in a cross-sectional plane.

According to the basic principle of the invention, the number of microfissures in the hard chromium layer is intentionally increased, as compared to weapon barrels having conventional hard chromium layers, to such an extent that the hard chromium layer has at least 500 fissures per cm or at least 150 fissures per cm on its outer surface. The result that an increase of the number of fissures within the hard chromium layer leads to an improvement of the thermal shock resistance of a weapon barrel is surprising, since the microfissures of known weapons are precisely the triggering cause for the peeling of the chromium layer and therefore the desideratum has been to maintain the number of the microfissures as small as possible. While the earlier-noted German Offenlegungsschrift 41 07 273 has also proposed to increase the number of microfissures after the chromium layer is applied, the additional microfissures in the upper face of the chromium layer serve merely for ensuring a better adherence of the low-friction layer which fills the microfissures.

The improved resistance to thermal shocks achieved by increasing the number of fissures may be explained as follows: upon firing a shot, the substantially brittle chromium layer is exposed to high stresses which lead to substantial, thermally induced expansions and tensions. As soon as the expansions exceed the elastic limit of the chromium layer, they are taken up by the already present and by the additionally appearing fissures. In conventional chromium layers in which the number of fissures measured cross-sectionally is approximately between 200/cm and 400/cm or the number of fissures measured on the surface of the chromium layer amounts to approximately between 40/cm and 70/cm, the fissures have to take up a relatively high proportion of the expansion caused by the thermal shock so that they combine to form relatively large fissures which are then responsible for the peeling of the chromium layer.

The invention thus proposes to minimize the proportion of the expansion as related to each individual fissure by intentionally increasing the number of fissures so that a combination into large fissures which are responsible for the peeling of the chromium layer may no longer occur.

As concerns the different numbers of fissures on the upper surface and across the hard chromium layer, it is noted that essentially there is no preferred direction of the chromium fissure frequency. The fissures are obtained during the galvanic deposition of the chromium by the inherent high pulling stresses generated during deposition. Upon reaching a certain minimum layer thickness (approximately 5 $\mu$m), fissures propagate in the chromium layer from the surface and release a large proportion of the inherent stresses. As the chromium deposition continues, the fissures are grown over by a chromium layer which, after reaching a certain thickness, likewise develops fissures. Such a process continues, so that, as a result, a labyrinth-like structure is obtained. It is understandable that the number of fissures per path length is greater along the cross section of the chromium layer than along the surface, since the fissures in the chromium layer are initiated from its outer surface.

In addition to an improved thermal shock resistance, the weapon barrel according to the invention has the further advantage that a thicker chromium layer may be provided as compared to known weapon barrels; such a thicker chromium layer provides for a better protection of the barrel material. Further, the chromium layer according to the invention is less sensitive to mechanical stresses (for example, when contacting the projectile) and therefore such a chromium layer may also find advantageous use in automatic weapons.

The fissure frequency may also be controlled by the composition of the electrolyte used for the chromium deposition, by the temperature of the galvanizing process and by the manner in which the current is guided; the optimal parameters may be empirically determined for each mode of application.

BRIEF DESCRIPTION OF THE DRAWINGS

FIG. 1 is an axial sectional view of a weapon barrel incorporating the invention.

FIG. 2 is a fragmentary sectional enlarged view taken along line II—II of FIG. 1.

DESCRIPTION OF THE PREFERRED EMBODIMENT

In FIG. 1 a weapon barrel 1 is shown which includes a chamber 2. The inner face of the weapon barrel 1 is provided with a hard chromium layer 3 having a thickness 4 and extending along the barrel axis 5.

Turning to FIG. 2, the hard chromium layer 3 has a plurality of microfissures 6 which, according to the invention, number at least 500/cm in the cross-sectional plane or at least 150/cm on the outer surface of the chromium layer.

It will be understood that the above description of the present invention is susceptible to various modifications, changes and adaptations, and the same are intended to be comprehended within the meaning and range of equivalents of the appended claims.

What is claimed is:

1. A weapon barrel having an inner surface and comprising a hard chromium layer provided on said inner surface; said hard chromium layer having at least 500 fissures/cm in a cross-sectional plane for improving a thermal shock resistance of said layer.

2. The weapon barrel as defined in claim 1, wherein said hard chromium layer has an upper surface containing at least 150 fissures/cm.

* * * * *